US012092389B2

(12) United States Patent
Fei et al.

(10) Patent No.: US 12,092,389 B2
(45) Date of Patent: Sep. 17, 2024

(54) BUILT-IN REFRIGERATOR AND INSTALLATION DEVICE AND AUXILIARY INSTALLATION ASSEMBLY THEREFOR

(71) Applicants: QINGDAO HAIER REFRIGERATOR CO., LTD., Shandong (CN); HAIER SMART HOME CO., LTD., Shandong (CN)

(72) Inventors: Bin Fei, Qingdao (CN); Changzhi Wang, Qingdao (CN); Xiaobing Zhu, Qingdao (CN); Enpin Xia, Qingdao (CN); Peng Li, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 166 days.

(21) Appl. No.: 17/789,428

(22) PCT Filed: Sep. 1, 2020

(86) PCT No.: PCT/CN2020/112852
§ 371 (c)(1),
(2) Date: Jun. 27, 2022

(87) PCT Pub. No.: WO2021/135333
PCT Pub. Date: Jul. 8, 2021

(65) Prior Publication Data

US 2023/0055104 A1 Feb. 23, 2023

(30) Foreign Application Priority Data

Dec. 30, 2019 (CN) ..... 201911403737.7

(51) Int. Cl.
*F25D 23/10* (2006.01)

(52) U.S. Cl.
CPC ..... *F25D 23/10* (2013.01); *F25D 2323/0011* (2013.01)

(58) Field of Classification Search
CPC ... F25D 23/10; F25D 2323/0011; F25D 23/00
(Continued)

(56) References Cited

U.S. PATENT DOCUMENTS 3,653,532 A 4/1972 Mann
4,124,187 A * 11/1978 Webb ..... A47B 91/16 248/188.3

(Continued)

FOREIGN PATENT DOCUMENTS

CN 2398756 Y 9/2000
CN 1690605 A * 11/2005

(Continued)

OTHER PUBLICATIONS

Notice of Intention to Grant for EP Patent Application No. 20910929.7 dated Jun. 28, 2023 (44 pages).

(Continued)

*Primary Examiner* — Steve S Tanenbaum
(74) *Attorney, Agent, or Firm* — Alston & Bird LLP

(57) ABSTRACT

An installation device for a built-in refrigerator, comprising: a fixing frame, provided on a bottom plate of a refrigerator in a front-back extension direction of the refrigerator; and at least one guide block, disposed on the fixing frame, the bottom of the guide block being provided with a groove parallel to the front-back extension direction of the refrigerator, and the groove being configured to match a guide rail portion pre-installed on the ground where an installation space is located, to limit the refrigerator to move in the front-back direction, so that the refrigerator can move backward along a preset path to reach an installation position.

8 Claims, 11 Drawing Sheets

(58) Field of Classification Search
USPC ..... 62/259.1
See application file for complete search history.

(56) References Cited

U.S. PATENT DOCUMENTS

| | | | | |
|---|---|---|---|---|
| 5,749,550 | A * | 5/1998 | Jackson | F16M 7/00 248/188.4 |
| 10,345,027 | B1 * | 7/2019 | Lundqvist | F16M 11/048 |
| 2004/0041503 | A1 | 3/2004 | Lee | |
| 2019/0226754 | A1 * | 7/2019 | Lindel | F25D 11/02 |

FOREIGN PATENT DOCUMENTS

| | | | |
|---|---|---|---|
| CN | 1862164 | A | 11/2006 |
| CN | 202544656 | U | 11/2012 |
| CN | 108518145 | A | 9/2018 |
| CN | 207847434 | U | 9/2018 |
| CN | 109140868 | A | 1/2019 |
| CN | 209119570 | U | 7/2019 |
| CN | 209246490 | U | 8/2019 |
| CN | 211601308 | U | 9/2020 |
| JP | S62-137032 | | 6/1987 |
| JP | 50-059083 | | 1/1993 |
| JP | H-094451 | | 1/1997 |
| JP | 10205981 | A | 8/1998 |
| JP | 2003-031683 | | 1/2003 |
| JP | 2008-051440 | | 3/2008 |
| KR | 2009-0098573 | A | 9/2009 |

OTHER PUBLICATIONS

1st Office Action for JP Patent Application No. 2022-537076 (6 pages).
Search Report for EP Application No. 20910929.7 dated Nov. 9, 2022 (4 pages).
1st Office Action for EP Application No. 20910929.7 dated Nov. 21, 2022 (6 pages).
2nd Office Action for EP Application No. 20910929.7 dated May 2, 2023 (5 pages).
International Search Report and Written Opinion for PCT/CN2020/112852 (ISA/CN) mailed Nov. 30, 2020 (10 pages).

* cited by examiner

BUILT-IN REFRIGERATOR AND INSTALLATION DEVICE AND AUXILIARY INSTALLATION ASSEMBLY THEREFOR

CROSS-REFERENCE TO RELATED APPLICATIONS

The present application is a national phase entry of International Application No. PCT/CN2020/112852, filed Sep. 1, 2020, which claims priority to Chinese Patent Application No. 201911403737.7, filed Dec. 30, 2019, which are each incorporated herein by reference in their entirety.

FIELD OF THE INVENTION

The present invention relates to the field of refrigerators, and in particular to a built-in refrigerator, and an installation device and an auxiliary installation assembly therefor.

BACKGROUND OF THE INVENTION

Installing a built-in refrigerator demands embedding a box body into a reserved installation space in a household cabinet. However, because the volume of the installation space is approximately equal to that of the box body, in the process of the installation, the user can only apply acting force on the front side of the box body to push the box body into the installation space. In the process of moving the box body, it is greatly easy to result in problems that the box body skews and moves in a winding manner due to uneven stress, making the entire process of installation very difficult.

Therefore, how to reduce the installation difficulty of a built-in refrigerator becomes a technical problem to be urgently solved by those skilled in the art.

BRIEF DESCRIPTION OF THE INVENTION

An object of the present invention is to provide a built-in refrigerator, and an installation device and an auxiliary installation assembly therefor which are capable of at least solving any one of the aspects in the above technical problem.

A further object of the present invention is to enable the built-in refrigerator to get in and out of the installation space in a fixed direction, so that the installation difficulty of the built-in refrigerator is reduced.

A further object of the present invention is to achieve a quick installation of the built-in refrigerator.

A further object of the present invention is to reinforce the integrity between the built-in refrigerator and a cabinet.

A further object of the present invention is to improve the installation aesthetics of the built-in refrigerator.

According to an aspect of the present invention, an installation device for a built-in refrigerator is provided, and is used for installing the built-in refrigerator into an installation space in a cabinet. The installation device includes: a fixing frame, disposed on a bottom plate of the refrigerator in a front-back extension direction of the refrigerator; and at least one guide block, disposed on the fixing frame, wherein the bottom of the guide block is provided with a groove parallel to the front-back extension direction of the refrigerator, and the groove is configured to match a guide rail portion pre-installed on the ground where the installation space is located, to limit the refrigerator to move in the front-back direction.

Optionally, the number of the guide block is more than one, the guide blocks being disposed at intervals along the fixing frame, and grooves of the plurality of the guide blocks are at a same straight line parallel to the front-back extension direction of the refrigerator.

Optionally, the plurality of guide blocks includes: a first guide block, located at the back end of the fixing frame;

the back portion of the first guide block is formed with a bell mouth expanding backward from a lateral side wall of the groove, and the bell mouth is configured to be assembled with one side of the guide rail portion that faces the outside of the installation space, to guide the refrigerator onto the guide rail portion.

Optionally, the installation device further includes a plurality of pulley assemblies disposed in the intervals between the plurality of guide blocks and configured to slide along the surface of the guide rail portion to decrease frictional resistance generated when the refrigerator moves.

Optionally, the pulley assembly include: a plurality of runners sequentially arranged in an extension direction of the groove, wherein the outer peripheral edge of the runners is formed in a shape matching the top end of the guide rail portion; and a connector having a shaft hole for matching the two ends of a central rotating shaft of each runner, so that the central rotating shaft of the plurality of runners is rotatably connected onto the connector.

Optionally, the number of the connectors is two, the connectors are respectively on two lateral sides of the plurality of runners, and the pulley assembly further include: a fixing shaft disposed between the two connectors in a penetrating manner; and a cover housing fixedly connected to the two ends of the fixing shaft and configured to limit the runners in the cover housing, wherein the bottom of the cover housing is provided with an opening to allow the runners to be in contact with the surface of the guide rail portion.

Optionally, the installation device further includes a plurality of leveling feet disposed at the bottom of the refrigerator, located in front of a front bottom pulley of the refrigerator, and configured to level the refrigerator by adjusting a height thereof.

According to another aspect of the present invention, a built-in refrigerator is further provided, including: a box body; and the installation device as described in any one of the foregoing items disposed at the bottom of the box body.

According to still another aspect of the present invention, an auxiliary installation assembly for a built-in refrigerator is further provided to install a refrigerator into an installation space in a cabinet, the auxiliary installation assembly including:

a rail assembly configured to at least be disposed on a lateral side of the ground where the installation space is located, and configured to be disposed in a front-back extension direction of the ground, to allow the refrigerator to get in and out of the installation space in the front-back direction, and the rail assembly includes: a bottom plate portion, configured to be laid on the ground; and a guide rail portion formed extending upward from the surface of the bottom plate portion and configured to allow a guide block of the installation device as described in any one of the foregoing items to move along the surface thereof.

Optionally, the rail assembly further includes: a limiting portion formed extending upward from the surface of the bottom plate portion and disposed parallel to the guide rail portion at an interval; the auxiliary installation assembly further includes: a positioning member configured to be disposed on the ground parallel to an extension direction of the rail assembly, and having a positioning strip parallel to the limiting portion, wherein the guide rail portion is located between the positioning strip and the limiting portion, and the positioning member is further configured to match the limiting portion to adjust a moving path of the refrigerator when the guide block deviates from the guide rail portion; and a pad located between the rail assembly and the positioning member and configured to elevate a back bottom pulley of the refrigerator when the refrigerator moves to an installation position.

According to a built-in refrigerator, an installation device and an auxiliary installation assembly therefor of the present invention, the installation device for the built-in refrigerator includes a guide block, wherein the bottom of the guide block is provided with a groove parallel to a front-back extension direction of the refrigerator, and the groove is configured to match with a guide rail portion pre-installed on the ground where the installation space is located to limit the refrigerator to move in the front-back direction, so that the refrigerator can move backward along a preset path to the installation position, the operation is simple, time-saving and labor-saving, avoiding the problem that in a moving process, due to uneven stress, the box body of the refrigerator is skewed, moves forward in a winding manner, and can hardly get in and out of the installation space, and iii reducing the installation difficulty of the built-in refrigerator.

Further, according to the built-in refrigerator, the installation device and the auxiliary installation assembly therefor of the present invention, with a mutual matching of the installation device and the auxiliary installation assembly, the built-in refrigerator can move to the installation position along the preset path, so that the refrigerator can be moved in one step, thereby avoiding repeatedly adjusting the position of the refrigerator in the process of installation, improving an installation efficiency of the built-in refrigerator, and achieving a quick installation of the built-in refrigerator.

Further, according to the built-in refrigerator, the installation device and the auxiliary installation assembly therefor of the present invention, the position of the auxiliary installation assembly on the ground where the installation space is located can be adjusted to adjust the size of a gap between the refrigerator and the side wall of the cabinet as well as the refrigerator and the back wall of the cabinet, so that the refrigerator and the cabinet are kept flush, reinforcing the integrity between the built-in refrigerator and the cabinet.

Further, according to the built-in refrigerator, the installation device and the auxiliary installation assembly therefor of the present invention, the auxiliary installation assembly includes a pad pre-installed on the ground and configured to elevate the back portion of the refrigerator when the refrigerator moves to an installation position; the installation device further includes a plurality of leveling feet disposed at the bottom of the refrigerator and configured to level the refrigerator by adjusting a height thereof, wherein the pad is first used to elevate the back portion of the refrigerator, and then the leveling feet are used to adjust the height of the front portion of the refrigerator, which is convenient and efficient, can quickly adjust the top and bottom of the refrigerator to the same horizontal plane after the refrigerator reaches the installation position, improving the aesthetics of the built-in refrigerator.

Specific embodiments of the present invention will be described in detail below with reference to the accompanying drawings, and those skilled in the art will better understand the above and other objectives, advantages and features of the present invention.

BRIEF DESCRIPTION OF THE DRAWINGS

Hereinafter, some specific embodiments of the present invention will be described in detail in an exemplary rather than restrictive manner with reference to the accompanying drawings. In the drawings, like reference numerals denote like or similar components or parts. Those skilled in the art should understand that these drawings are not necessarily drawn to scale. In the figures.

DETAILED DESCRIPTION

Figure 1:
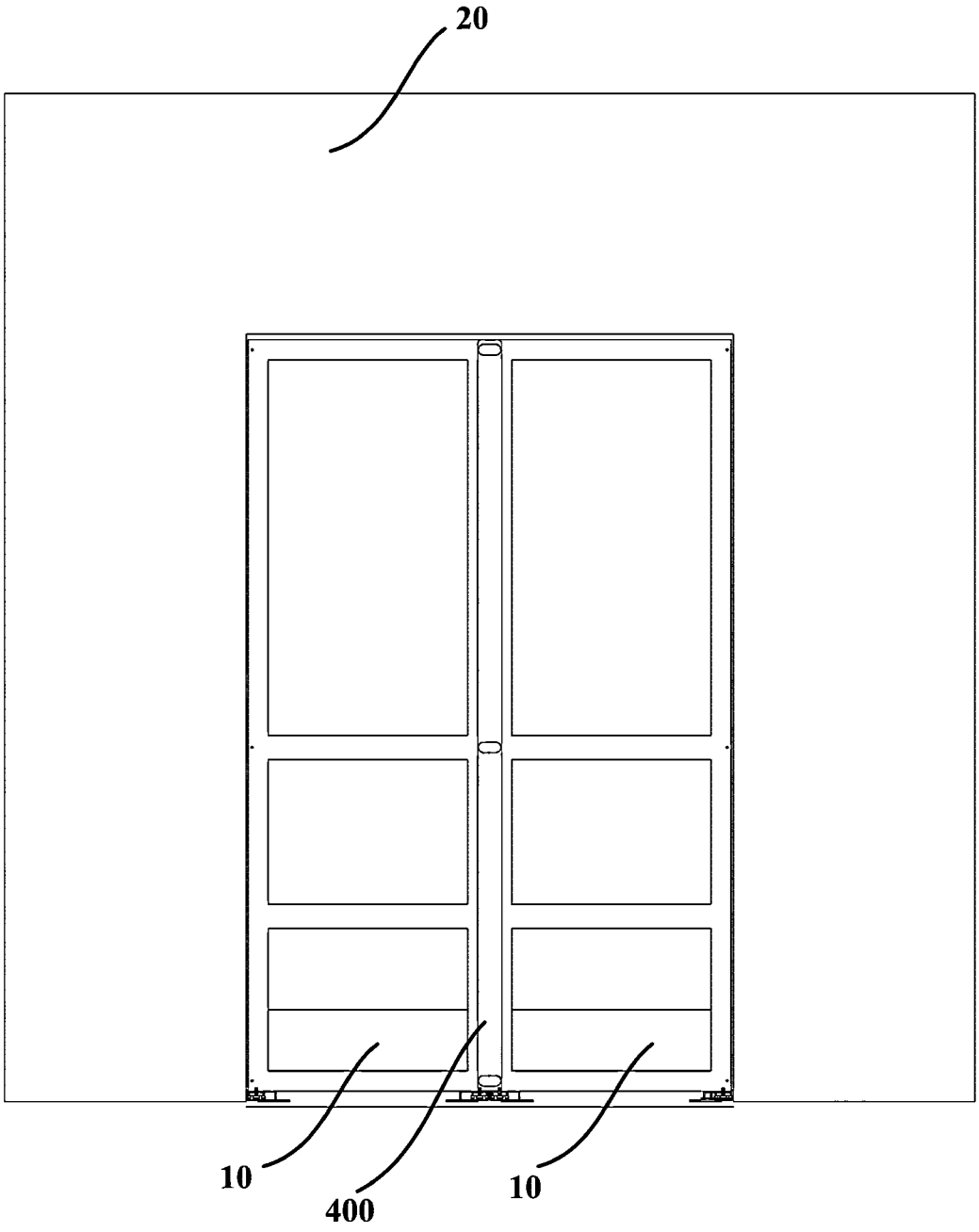
FIG. 1 is an assembly view of a built-in refrigerator according to an embodiment of the present invention.
Figure 2:
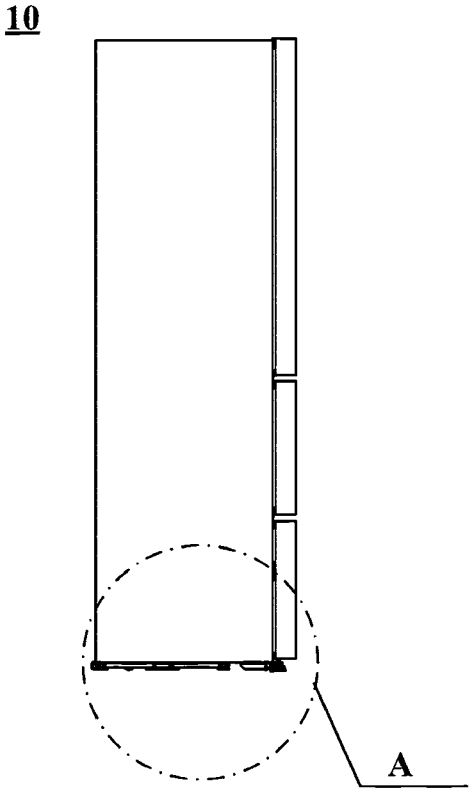
FIG. 2 is a left view of a built-in refrigerator according to an embodiment of the present invention.
Figure 3:
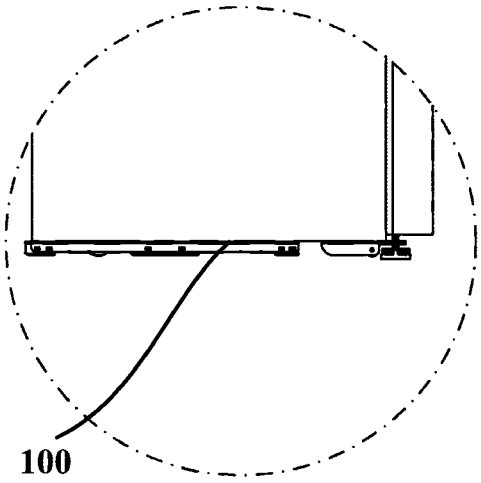
FIG. 3 is a partial enlarged view of part A in FIG. 2.
Figure 4:
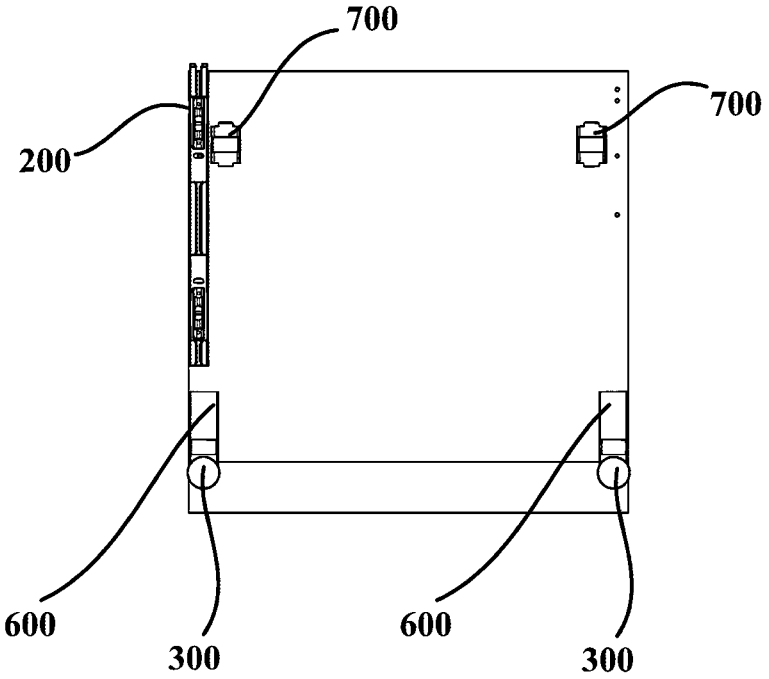
FIG. 4 is a bottom view of a built-in refrigerator shown in FIG. 2.

FIG. 1 is an assembly view of a built-in refrigerator 10 according to an embodiment of the present invention; FIG. 2 is a left view of a built-in refrigerator 10 according to an embodiment of the present invention; FIG. 3 is a partial enlarged view of part A in FIG. 2; and FIG. 4 is a bottom view of the built-in refrigerator 10 shown in FIG. 2.

The built-in refrigerator 10 (hereinafter referred to as "refrigerator") may generally include: a box body and an installation device 100 disposed at the bottom of the box body. In this embodiment, the bottom of the refrigerator 10 may be pre-installed with a bottom pulley, and the number of the bottom pulley may be four, the bottom pulley including two front pulleys 600 and two back pulleys 700. The installation device 100 for the built-in refrigerator 10 is used for installing the refrigerator 10 into a cabinet 20, and an installation space of the refrigerator 10 is formed in the cabinet 20. The cuboid-shaped installation space is enclosed jointly by a back wall, a side wall and a top wall of the cabinet 20 as well as the ground where the installation space is located. An installation position of the refrigerator 10 refers to a specific position of the refrigerator 10 in the installation space.

The installation space can accommodate the single refrigerator 10, and can also accommodate the modular refrigerator 10 in any quantity, and the specific arrangement plan can be determined according to a practical need. In this embodiment, the installation space can accommodate two modular refrigerators 10 which can be parallelly disposed in a lateral extension direction of the installation space.

Figure 5:
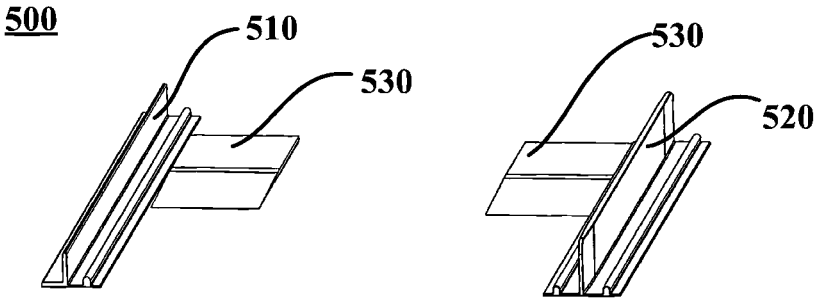
FIG. 5 is a schematic diagram of an auxiliary installation assembly for a built-in refrigerator according to an embodiment of the present invention.

FIG. 5 is a schematic diagram of an auxiliary installation assembly 500 for the built-in refrigerator 10 according to an embodiment of the present invention.

The built-in refrigerator 10 may further include the auxiliary installation assembly 500. The auxiliary installation assembly 500 for a built-in refrigerator 10 is used for installing the refrigerator 10 into an installation space in a cabinet 20.

The auxiliary installation assembly 500 is configured to be pre-installed on the ground where the installation space is located, is used for assisting in limiting a moving path and an installation position of the refrigerator 10, and is further used for assisting in leveling the refrigerator 10. The auxiliary installation assembly 500 includes: a rail assembly 510, a positioning member 520 and a pad 530.

Figure 6:
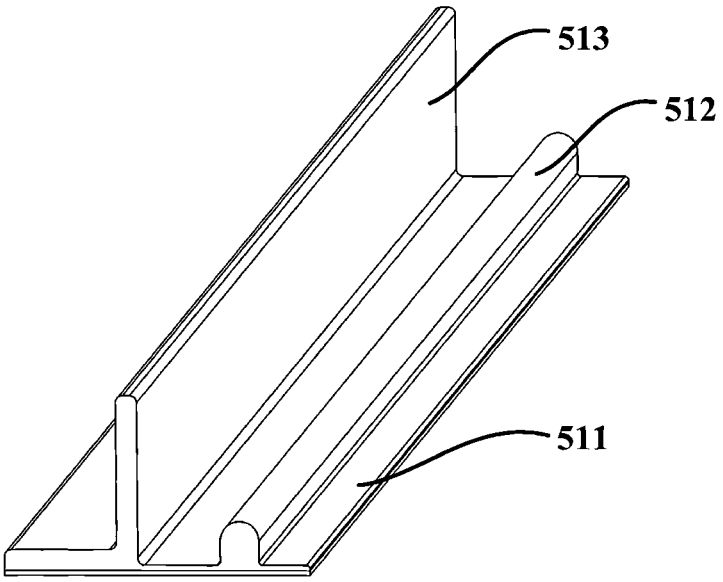
FIG. 6 is a schematic diagram of a rail assembly of the auxiliary installation assembly for the built-in refrigerator shown in FIG. 5.

FIG. 6 is a schematic diagram of a rail assembly 510 of the auxiliary installation assembly 500 for the built-in refrigerator 10 shown in FIG. 5.

The rail assembly 510 is configured to at least be disposed on a lateral side of the ground where the installation space is located, and is configured to be disposed in a front-back extension direction of the ground, to allow the refrigerator 10 to get in and out of the installation space in the front-back direction. In this embodiment, the number of the built-in refrigerator 10 is two, and the number of the rail assembly 510 may be two; the rail assemblies 510 are used for being pre-installed on the lateral side of the above ground respectively, and are used for limiting the moving path and the installation position of each refrigerator 10. In some alternative embodiments, the number of the built-in refrigerator 10 is one, and the number of the rail assembly 510 may be one, or may be two. The rail assembly 510 can be fixed on the ground by means of screw connection or adhesion. The rail assembly 510 includes a bottom plate portion 511, a guide rail portion 512 and a limiting portion 513.

In this embodiment, the definitions of the auxiliary installation assembly 500 and terms "front", "rear", "back", "side", "top", and the like used to indicate the orientation or positional relationship are relative to the actual usage state of the auxiliary installation assembly 500 on the ground where the installation space is located. The definitions of an installation device 100 and terms "front", "rear", "back", "side", "top", and the like used to indicate the orientation or positional relationship are relative to the actual usage state of the refrigerator 10 in the installation space.

The bottom plate portion 511 is configured to be laid on the ground. According to the rail assembly 510, the bottom plate portion 511 can be connected on the ground by screw or adhesive on the ground to achieve the integral fixing of the rail assembly 510. The bottom plate portion 511 may be in a rectangular plate shape extending from the front to the back in parallel to the front-back extension direction of the ground. A side of the bottom plate portion 511 close to a side wall of a cabinet 20 can be disposed by abutting against the side wall of the cabinet 20. A side of the bottom plate portion 511 close to a back wall of the cabinet 20 may be spaced at a preset distance from the back wall of the cabinet 20, and the size of the preset distance can be set according to a practical need, so that a gap with a determined size can be formed between a wall plate of the refrigerator 10 and the back wall of the cabinet 20.

The guide rail portion 512 is formed extending upward from the surface of the bottom plate portion 511 and is configured to allow a guide block of the installation device 100 mentioned below to move along the surface thereof. That is, the guide rail portion 512 forms a moving track of the guide block. In this embodiment, the guide rail portion 512 forms a moving track of the guide block and a pulley assembly 220. The guide rail portion 512 may be in a plate shape, be perpendicular to the bottom plate portion 511, and be disposed parallel to the front-back extension direction of the ground.

The guide rail portion 512 keeps parallel to the side wall of the cabinet 20 to enable the refrigerator 10, in the process of moving into the installation position from the front to the back, to keep parallel to the side wall of the cabinet 20 all the time, so that the size of the gap does not need to be adjusted again repeatedly between the refrigerator 10 and the side wall of the cabinet 20 after the refrigerator 10 reaching the installation position, improving an installation efficiency.

To reduce the resistance appearing when the refrigerator 10 moves, the part of the guide rail portion 512 in contact with a groove 212 of the guide block can be set as a smooth curved surface, so that the curved surface and the groove 212 of the guide block can mutually match to reduce the reduce the frictional resistance appearing when the refrigerator 10 moves.

A side of the guide rail portion 512 close to the back wall of the cabinet 20 may be provided with a stopper for preventing the refrigerator 10 from moving backward after reaching the installation device 100, thereby making the refrigerator 10 stop moving. After stopping moving, the refrigerator 10 reaches a specified installation position. The stopper may be spaced a fixed distance from the back wall of the cabinet 20, and the length of the fixed distance can be set according to a practical need, so that a gap with a determined size can be formed between a back plate of the refrigerator 10 and the back wall of the cabinet 20.

The above auxiliary installation assembly 500 of the present embodiment not only provides a preset moving track for the refrigerator 10 to ensure that the refrigerator 10 performs a linear motion along the preset path to move to the installation position, but also can enable the refrigerator 10 to reach the installation position specified by a user, and provide a gap between the refrigerator 10 and the cabinet 20, wherein the size of the gap can be adjusted by adjusting the position of the auxiliary installation assembly 500, improving the installation flexibility of the refrigerator 10.

The limiting portion 513 is formed extending upward from the surface of the bottom plate portion 511, and is disposed parallel to the guide rail portion 512 at an interval. The limiting portion 513 is higher than the guide rail portion 512, and is further configured to be parallel to the side wall of the cabinet 20, and to adjoin the side wall of the refrigerator 10 and a fixing frame 240 of the installation device 100 when the refrigerator 10 moves, so as to adjust the moving path of the refrigerator 10 when the guide block deviates from the guide rail portion 512. That is, the limiting portion 513 is used for preventing the guide block from disengaging from the guide rail portion 512, and the limiting portion 513 cooperates with the guide rail portion 512 so that the guide block moves from the front to the back strictly in a direction parallel to the side wall of the cabinet 20. In this embodiment, the limiting portion 513 may be in a plate shape, be perpendicular to the bottom plate portion 511, and be disposed in a front-back extension direction of the ground. On the bottom plate portion 511, the limiting portion 513 may be on the side of the bottom plate portion 511 close to the side wall of the cabinet 20, and the guide rail portion 512 may be on the side of the bottom plate portion 511 away from the side wall of the above cabinet 20. The limiting portion 513 may be spaced at a set distance from the side wall of the cabinet 20, and the length of the set distance can be set according to a practical need, so that the gap with a determined size can be formed between a side plate of the refrigerator 10 and the side wall of the cabinet 20.

When the refrigerator 10 moves, the groove 212 of the guide block can be engaged with the guide rail portion 512, and the surface of the guide block that faces the side wall of the cabinet 20 can further abut against the limiting portion 513, the guide rail portion 512 and the limiting portion 513 mutually match to strictly limit the moving path of the refrigerator 10, to enable the refrigerator 10 to reach the specified installation position along the preset path, and at the same time, after the refrigerator 10 reaches the installation position, to provide gaps with a determined size between the refrigerator 10 and the side wall of the cabinet 20 as well as the refrigerator 10 and the back wall of the cabinet 20, so that the position of the refrigerator 10 does not need to be repeatedly adjusted after the refrigerator 10 reaches the installation position, which is simple, convenient and quick, easy to realize, time-saving and labor-saving, and improves an installation efficiency of the built-in refrigerator 10.

Figure 7:
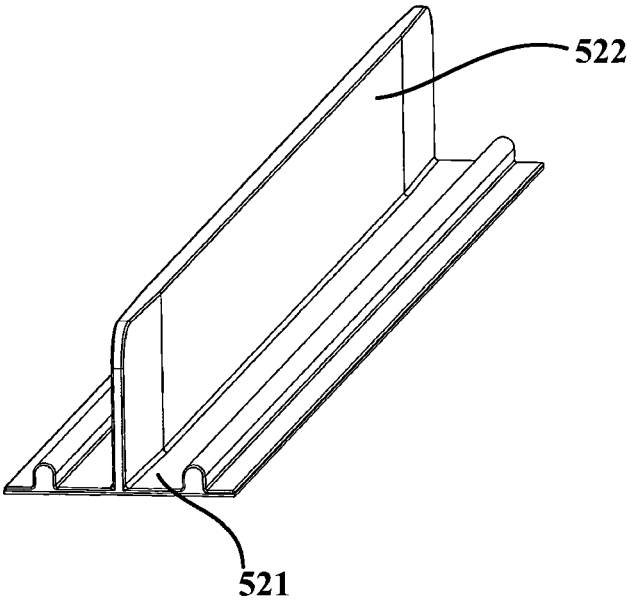
FIG. 7 is a schematic diagram of a positioning member of the auxiliary installation assembly for the built-in refrigerator shown in FIG. 5.

FIG. 7 is a schematic diagram of a positioning member 520 of the auxiliary installation assembly 500 shown in FIG. 5.

The positioning member 520 is configured to be disposed on the ground parallel to an extension direction of a rail assembly 510, and has a positioning strip 522 parallel to the limiting portion 513, wherein a guide rail portion 512 is located between the positioning strip 522 and the limiting portion 513, and the positioning member 520 is further configured to match the limiting portion 513 to adjust the moving path of the refrigerator 10 when the guide portion deviates from the guide rail portion 512. The positioning member 520 has a positioning plate 521 laid on the ground and a positioning strip 522 formed extending upward from the surface of the positioning plate 521. The positioning strip 522 is parallel to a side wall of a cabinet 20. In this embodiment, the positioning member 520 can be pre-installed on the ground, when the above installation space is used for installing two modular refrigerators 10, the positioning member 520 can be located between the above two rail assemblies 510; for example, the positioning member 520 can be located at the position between the above two rail assemblies 510 for mutually matching the rail assemblies 510 to limit the moving path of the two modular refrigerators 10. For the refrigerator 10 at an installation position, the rail assembly 510 is at a lateral end of the bottom of the refrigerator 10, while the positioning member 520 is at another lateral end of the bottom of the refrigerator 10. The positioning plate 521 may be in a rectangular plate shape, and is configured to extend from the front to the back along the lateral extension direction of the ground. The positioning strip 522 may be in a plate shape, be perpendicular to the positioning plate 521, and be disposed parallel to the front-back extension direction of the ground. When the refrigerator 10 moves or after the refrigerator 10 reaches the installation position, the positioning strip 522 has a surface facing the side plate of one refrigerator 10 and another surface facing the side plate of another refrigerator 10.

The distance between the positioning strip 522 and the limiting portion 513 of the rail assembly 510 can be set according to a practical need, for example, the length of the distance can fit with a lateral dimension of the box body of the refrigerator 10, so that the positioning strip 522 and the rail assembly 510 can mutually match to limit the installation position and the moving path of the refrigerator 10.

By adjusting the position of the auxiliary installation assembly 500 on the ground where the installation space is located, the size of gaps can be adjusted between the refrigerator 10 and the side wall of the cabinet 20 as well as the refrigerator 10 and the back wall of the cabinet 20, so that the refrigerator 10 and the cabinet 20 are kept flush, reinforcing the integrity between the built-in refrigerator 10 and the cabinet 20.

The pad 530 is located between the rail assembly 510 and the positioning member 520, and is configured to elevate a back bottom pulley (i.e. a back pulley 700) of the refrigerator 10 when the refrigerator 10 moves to the installation position to make the refrigerator slightly forward incline, that is, when the refrigerator 10 moves to the installation position, the pad 530 makes the back of the refrigerator 10 higher than the front of the refrigerator 10, and in this way, the refrigerator 10 can be leveled only by adjusting the height of the front of the refrigerator 10. In this embodiment, the number of the pad 530 may be more than one, and the number thereof can be set according to that of the back pulley 700 of the refrigerator 10; for example, the number of the refrigerator 10 of the present embodiment is two, the number of the back pulley 700 is four, the number of the pad 530 may be four, and the pads 530 can be pre-installed on the back of the above ground, and be used for elevating the four back pulleys 700 of the two refrigerators 10 respectively. Each of the pad 530 may have a slope surface with a height gradually increasing in a backward extension direction and a platform extending backward in a horizontal direction from the top of the slope surface, wherein one platform is used for elevating one back pulley 700 of the refrigerator 10. The inclination and the length of the slope surface determine the height of the back pulley 700 of the refrigerator 10 elevated by the pad 530. When the refrigerator 10 moves, the back pulley 700 moves up to the platform along the slope surface, reducing the difficulty of elevating the back pulley 700 of the refrigerator 10.

Figure 8:
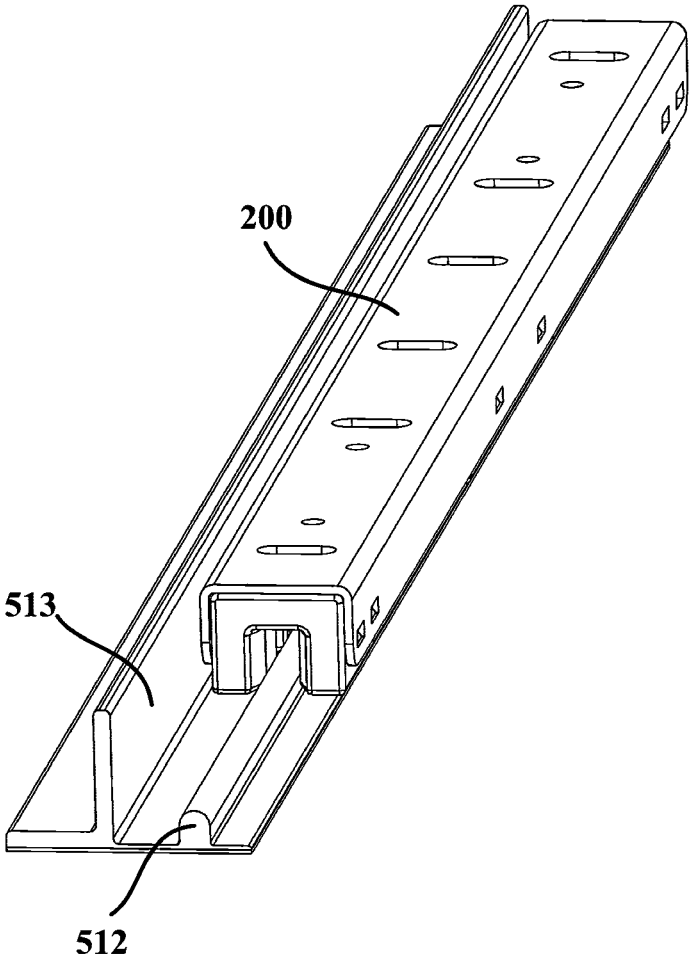
FIG. 8 is a schematic diagram of a matching of a positioning assembly and a rail assembly of an installation device for a built-in refrigerator according to an embodiment of the present invention, wherein the positioning assembly is a general term for a fixing frame, a guide block and a pulley assembly.
Figure 9:
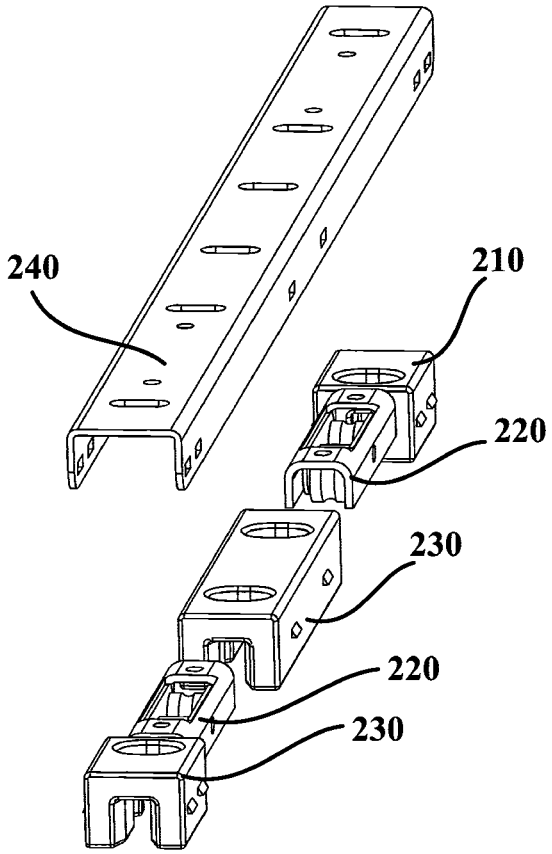
FIG. 9 is an exploded view of the positioning assembly of the installation device for the built-in refrigerator shown in FIG. 8.

FIG. 8 is a schematic diagram of a matching of a positioning assembly 200 and the rail assembly 510 of the installation device 100 for the built-in refrigerator 10 according to an embodiment of the present invention, wherein the positioning assembly 200 is a general term for the fixing frame 240, the guide block and the pulley assembly 220; and FIG. 9 is an exploded view of the positioning assembly 200 of the installation device 100 for the built-in refrigerator 10 shown in FIG. 8.

The installation device 100 for the built-in refrigerator 10 is used for installing the refrigerator 10 into the installation space in the cabinet 20. The installation device 100 may generally include the fixing frame 240 and at least one guide block, and may further include a plurality of pulley assemblies 220 and a plurality of leveling feet 300. When the refrigerator 10 is used as a independent refrigerator 10, a bottom pulley can be used for freely moving. The fixing frame 240, at least one guide block and the plurality of pulley assemblies 220 can be integrated to form the positioning assembly 200, and after the positioning assembly 200 is formed, the fixing frame 240, the guide block and the plurality of pulley assemblies 220 can be entirely installed at the bottom of the refrigerator 10 at one time, improving the assembly efficiency of the refrigerator 10.

In this embodiment, the number of the built-in refrigerator 10 may be two, and the number of the positioning assembly 200 may be two, wherein one positioning assembly 200 is arranged on one refrigerator 10; the number of the leveling foot 300 may be four, the leveling feet 300 being disposed on the front side of front pulleys 600 of the two refrigerators 10 respectively.

The fixing frame 240 is disposed on a bottom plate of the refrigerator 10 in a front-back extension direction of the refrigerator 10. The fixing frame 240 can adjoin a lateral perimeter of the bottom plate of the refrigerator 10. The fixing frame 240 has a first connecting plate for being connected and fixed to the bottom of the refrigerator 10 and second connecting plates formed extending downward from the two lateral ends of the first connecting plate, making the cross section of the fixing frame 240 be in an inverted U shape, and limiting an enclosure cavity in the fixing frame 240. The enclosure cavity is used for accommodating the below guide block and a plurality of pulley assemblies 220. The number of the second connecting plate is two, and the second connecting plate close to the lateral perimeter of the bottom plate of the refrigerator 10 and the side plate of the refrigerator 10 are kept flush, that is, the second connecting plate close to the lateral perimeter of the bottom plate of the refrigerator 10 is within the same plane as the side plate of the refrigerator 10. The fixing frame 240, the front pulley 600 and the back pulley 700 are all disposed on the bottom plate of the refrigerator 10, wherein the front pulley 600 is located on a front side of the fixing frame 240, and the back pulley 700 is located on an inner side of the fixing frame 240. The inner side refers to, relative to the fixing frame 240, the back pulley 700 is away from the lateral perimeter of the bottom plate of the refrigerator 10.

When the refrigerator 10 moves, the above limiting plate may abut against the second connecting plate of the fixing frame 240 close to the lateral perimeter of the bottom plate of the refrigerator 10 and the side plate of the refrigerator 10, and the positioning strip 522 may abut against another side plate of the refrigerator 10, so that the side plate of the refrigerator 10 can keep parallel to the side wall of the cabinet 20 all the time when the refrigerator 10 moves or after the refrigerator 10 reaches the specified installation position. The limiting plate, the positioning strip 522 and the fixing frame 240 provide a structure foundation when the refrigerator 10 moves along a straight line.

Figure 10:
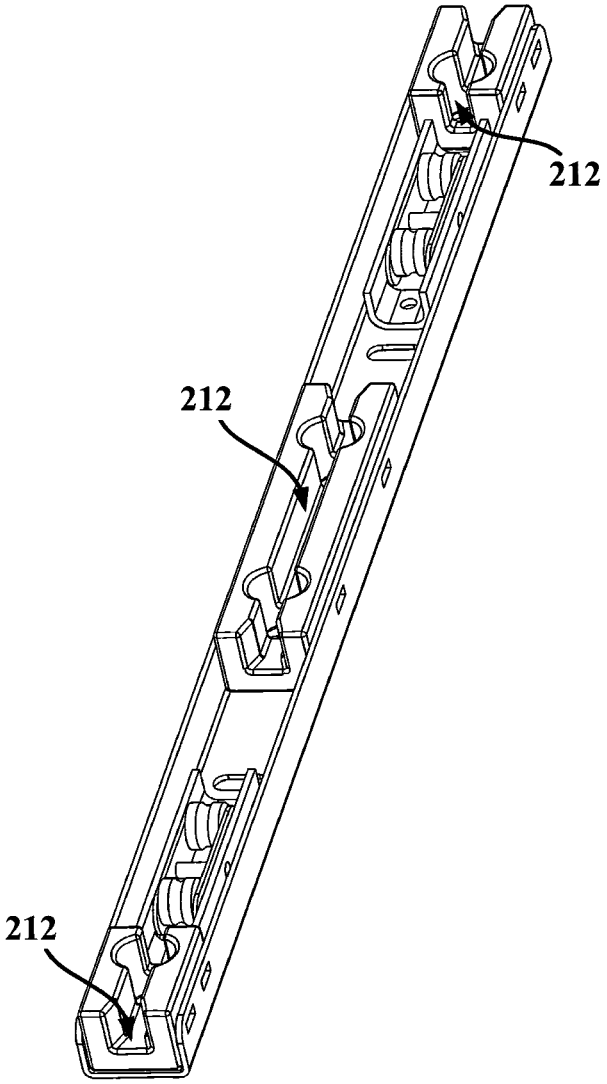
FIG. 10 is another schematic diagram of the positioning assembly of the installation device for the built-in refrigerator shown in FIG. 8.

FIG. 10 is another schematic diagram of the positioning assembly 200 of the installation device 100 of the built-in refrigerator 10 shown in FIG. 8.

At least one guide block, disposed on the fixing frame 240, wherein the bottom of the guide block is provided with the groove 212 parallel to the front-back extension direction of the refrigerator 10, and the groove 212 is configured to match the guide rail portion 512 pre-installed on the ground where the installation space is located, to limit the refrigerator 10 to move in the front-back direction. The number of the guide block is more than one, the blocks are disposed at intervals along the fixing frame 240, and grooves 212 of the plurality of guide blocks are at a same straight line parallel to the front-back extension direction of the refrigerator 10.

The shape of the guide rail portion 512 can adapt to that of the groove 212 to make the guide rail portion 512 located inside the groove 212 when the refrigerator 10 moves, and to make the refrigerator 10 be capable of moving backward in a straight line when the guide block moves on the guide rail portion 512.

According to the built-in refrigerator 10 of the present embodiment, the above installation device 100 and the auxiliary installation assembly 500 are used to enable the refrigerator 10 to move backward along a preset path in a straight line to the installation position, the operation is simple, time-saving and labor-saving, avoiding the problem that in a moving process, due to uneven stress, the box body of the refrigerator 10 is skewed, moves forward in a winding manner, and can hardly get in and out of the installation space, and reducing the installation difficulty of the built-in refrigerator 10.

The installation device 100 and the auxiliary installation assembly 500 mutually match to enable the built-in refrigerator 10 to move to the installation position along the preset path, so that the refrigerator 10 can be moved in one step, thereby avoiding repeatedly adjusting the position of the refrigerator 10 in the process of installation, improving an installation efficiency of the built-in refrigerator 10, and achieving a quick installation of the built-in refrigerator 10.

Figure 11:
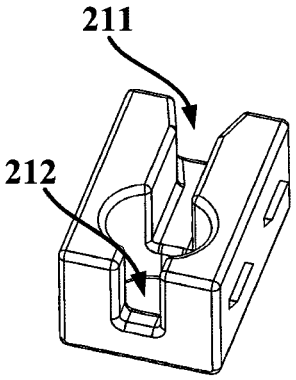
FIG. 11 is a schematic diagram of a first guide block of the positioning assembly of the installation device for the built-in refrigerator shown in FIG. 10.

FIG. 11 is a schematic diagram of a first guide block 210 of the positioning assembly 200 of the installation device 100 for the built-in refrigerator 10 shown in FIG. 10.

A plurality of guide blocks includes: the first guide block 210, located at the back end of the fixing frame 240. The back portion of the first guide block 210 is formed with a bell mouth 211 expanding backward from a lateral side wall of the groove 212, and the bell mouth 211 is configured to be assembled with one side of the guide rail portion 512 that faces the outside of an installation space, to guide the refrigerator 10 onto the guide rail portion 512. That is, the bell mouth 211 is formed by gradually expanding and extending backward of two side walls at two lateral ends of the groove 212, and is a bell-shaped access port, so that the bell mouth 211 can be used to guide the refrigerator 10 onto the guide rail portion 512. "Gradually expanding" is relative to "gradually contracting", and the bell mouth 211 is formed by expanding backward of lateral side walls of the groove 212 means that the size of the cross section opening of the bell mouth 211 is larger than that of the cross section opening of the groove 212.

When the refrigerator 10 moves to the front side of the installation space, the guide block is located on the front side of the guide rail portion 512, and because the opening of the bell mouth 211 is relatively large, as long as it is ensured that the guide rail portion 512 is located within the bell mouth 211 and the refrigerator 10 is pushed backward continuously, the guide rail portion 512 can enter the groove 212, so that the guide block can be quickly pushed onto the guide rail portion 512 without any precise aiming.

The height and shape of the guide rail portion 512 may adapt to the depth and shape of the groove 212 to enable the guide block to engage with the guide rail portion 512 by means of the groove 212, so that when the refrigerator 10 moves, the guide block is located on the guide rail portion 512 all the time, thereby preventing the refrigerator 10 from deviating from the preset track in the process of moving, and requiring no position adjustment after the refrigerator 10 reaches the specified installation position.

Figure 12:
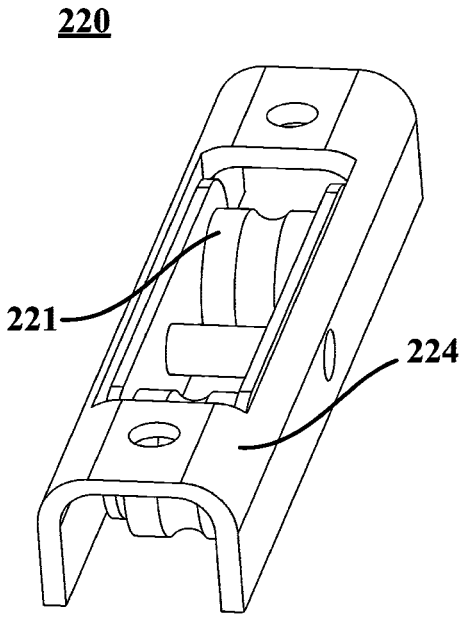
FIG. 12 is a schematic diagram of a pulley assembly of the positioning assembly of the installation device for the built-in refrigerator shown in FIG. 10.
Figure 13:
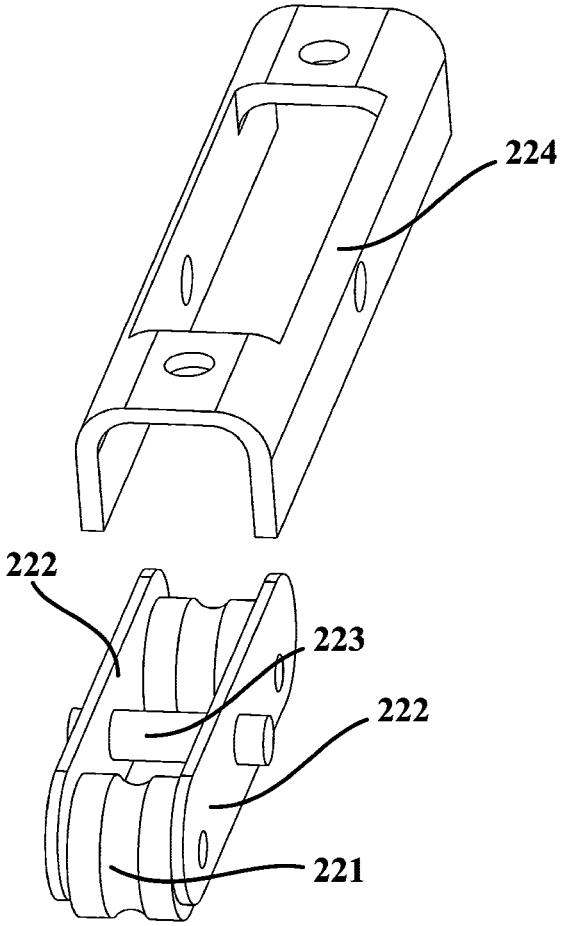
FIG. 13 is an exploded view of the pulley assembly of the positioning assembly of the installation device for the built-in refrigerator shown in FIG. 12.

FIG. 12 is a schematic diagram of the pulley assembly 220 of the positioning assembly 200 of the installation device 100 for the built-in refrigerator 10 shown in FIG. 10; and FIG. 13 is an exploded view of the pulley assembly 220 of the positioning assembly 200 of the installation device 100 for the built-in refrigerator 10 shown in FIG. 12.

A plurality of pulley assemblies 220 is disposed in the intervals between a plurality of guide blocks and is configured to slide along the surface of a guide rail portion 512 to decrease frictional resistance generated when the refrigerator 10 moves. Each of the pulley assembly 220 includes: a plurality of runners 221, a connector 222, a fixing shaft 223 and a cover housing 224.

The plurality of runners 221 is sequentially arranged in an extension direction of the groove 212, wherein the outer peripheral edge of the runners 221 is formed in a shape matching the top of the guide rail portion 512. The number of the runner 221 can be set according to a practical need; for example, the number may be two, three, four or five, and may also be one, and preferably, the number may be two. In this embodiment, the top of the guide rail portion 512 is formed with an arc-shaped curved surface protruding outward (relative to the guide rail portion 512), and the outer peripheral edge of the runner 221 is formed with an arc-shaped curved surface concaving inward (relative to the runner 221).

In this embodiment, the number of the guide block may be three, including the first guide block 210 and a second guide block 230, wherein the number of the second guide block 230 may be two, and the second guide blocks 230 are located at the middle and the front side of the fixing frame 240 respectively. That is, in the front-back extension direction of the refrigerator 10 and from the front to the back, the fixing frame 240 is sequentially provided with a second guide block 230, a pulley assembly 220, a second guide block 230, a pulley assembly 220 and the first guide block 210.

The runner 221 has a central rotating shaft, and the runner 221 rotates circumferentially around the central rotating shaft. The runner 221 further includes two wheel body portions disposed on the central rotating shaft in a penetrating manner and a connecting portion located between the two wheel body portions, wherein the connecting portion is formed by gradually contracting inward of peripheral edges of the two wheel body portions in an opposite direction. The shape of the top of the guide rail portion 512 may adapt to that of the connecting portion to make the connecting portion of the runner 221 located on the guide rail portion 512 when the refrigerator 10 moves, and the wheel body portion of the runner 221 may be suspendedly disposed, or located on the above bottom plate portion 511.

When the refrigerator 10 moves from the front to the back under the action of pushing, the runner 221 rotates around the central rotating shaft, and under the rotating action of the plurality of runners 221, the frictional resistance appearing when the refrigerator 10 moves can be reduced.

The connector 222 has a shaft hole for matching the two ends of a central rotating shaft of each runner 221, so that the central rotating shafts of the plurality of the runners 221 are rotatably connected onto the connector 222. In this embodiment, the number of the connector 222 may be two, and the connectors 222 are in sheet shapes respectively, parallelly disposed at an interval, and located on the two lateral sides of the plurality of runners 221 respectively, wherein one connector 222 is used for matching the tail end of the central rotating shaft located on the same side of the plurality of runners 221, the number of the shaft hole on each of the connectors 222 can be correspondingly set according to that of the runner 221, and the position of the shaft hole can adapt to the arrangement position of the plurality of runners 221. The aperture of the shaft hole may be slightly larger than the outer diameter of the central rotating shaft to prevent the problem that the seizure of the central rotating shaft in the shaft hole causes the runner 221 can not rotate.

A fixing shaft 223 is disposed between the two connectors 222 in a penetrating manner That is, the fixing shaft 223 is disposed parallel to the central rotating shaft. In this embodiment, the number of the runner 221 is two, and the fixing shaft 223 can be located between the two runners 221 for achieving a fixed connection to the connector 222 and the cover housing 224 (as will be described in detail below) to form the pulley assembly 220, so that the pulley assembly 220 is fixedly connected to the fixing frame 240, thereby completing the assembling of the positioning assembly 200. The connector 222 may further be provided with a fixing hole for fixed connection to the fixing shaft 223. The fixing shaft 223 can not rotate, because the fixing shaft 223 and the connector 222 are fixedly connected.

The cover housing 224 is fixedly connected to the two ends of the fixing shaft 223 and is configured to limit the runners 221 in the cover housing 224, wherein the bottom of the cover housing 224 is provided with an opening to allow the runners 221 to be in contact with the surface of the guide rail portion 512. The cover housing 224 may cover the runner 221, the connector 222 and the fixing shaft 223 to form the pulley assembly 220. The cover housing 224 is further provided with the fixing hole for fixed connection to the fixing shaft 223, that is, the connector 222 combines the plurality of runners 221 into a whole, and the fixing shaft 223 further combines the combination of the connector 222 with the plurality of runners 221 and the cover housing 224 into a whole to simplify the assembling step of the plurality of runners 221.

The fixing frame 240 can cover the top and the side part of the first guide block 210, the plurality of pulley assemblies 220 and the second guide block 230, and is configured to be connected to a bottom wall of the refrigerator 10 to fix the positioning assembly 200 on the refrigerator 10. The first connecting plate can be fixed on the bottom of the refrigerator 10 by means of screw connection. A side wall of the guide block can be provided with a plurality of jack catches, and the second connecting plate can be provided with a plurality of slots to make the guide block and the fixing frame 240 combined into a whole by clamping the jack catches and the slots; the cover housing 224 can be provided with a screw hole, and the first connecting plate can also be correspondingly provided with a screw hole to fix the pulley assembly 220 on the fixing frame 240 by means of screw connection, thereby forming the positioning assembly 200. In some alternative embodiments, the pulley assembly 220 can also be connected and fixed to the fixing frame 240 by means of riveting.

A plurality of leveling feet 300 is disposed at the bottom of a refrigerator 10, is located in front of a front bottom pulley of the refrigerator 10, and is configured to level the refrigerator 10 by adjusting a height thereof. In this embodiment, each of the refrigerators 10 can be provided with two leveling feet 300, and the leveling feet 300 can have different height by adjusting the height under the action of an installation tool, thereby making the front of the refrigerator 10 elevated or lowered, that is, the front and the back of the refrigerator 10 is kept flush by adjusting the height of the front of the refrigerator 10. In this embodiment, a gradienter can be used for determining the degree of levelness of the position where the refrigerator 10 is located.

In this embodiment, the pad 530 is first used to elevate the back portion of the refrigerator 10, and then the leveling feet 300 are used to adjust the height of the front portion of the refrigerator 10, which is convenient and efficient, can quickly adjust the top and bottom of the refrigerator 10 to the same horizontal plane after the refrigerator 10 reaches the installation position, and improves the aesthetics of the built-in refrigerator 10.

Figure 14:
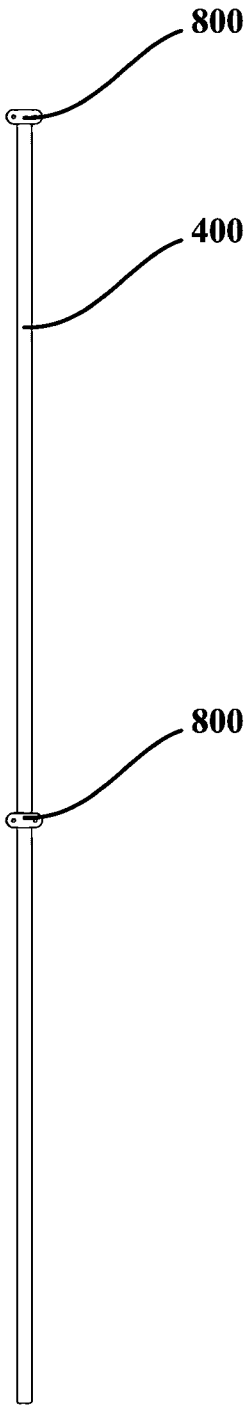
FIG. 14 is a schematic diagram of an insertion strip and a connecting sheet of an installation device for a built-in refrigerator according to an embodiment of the present invention.
Figure 15:
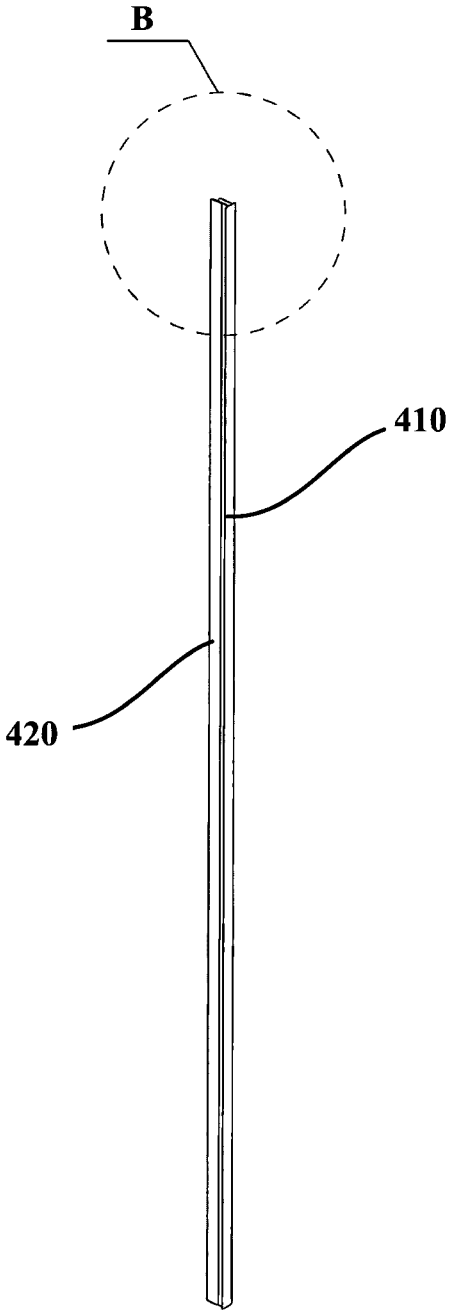
FIG. 15 is another schematic diagram of the insertion strip and the connecting sheet of the installation device for the built-in refrigerator shown in FIG. 14.
Figure 16:
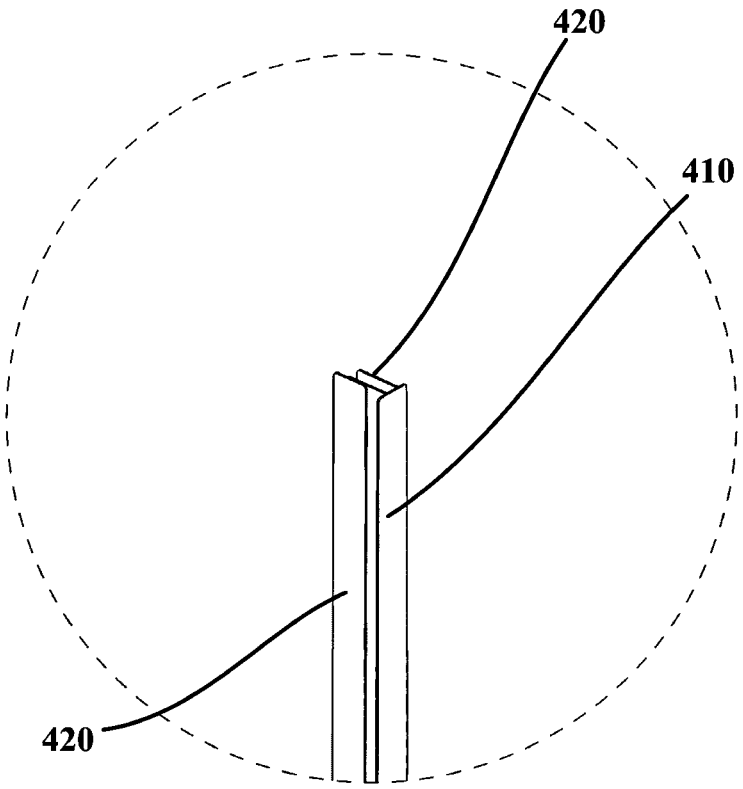
FIG. 16 is a partial enlarged view of part B in FIG. 15.

FIG. 14 is a schematic diagram of an insertion strip 400 and a connecting sheet 800 of the installation device 100 for the built-in refrigerator 10 according to an embodiment of the present invention; FIG. 15 is another schematic diagram of the insertion strip 400 and the connecting sheet 800 of the installation device 100 for the built-in refrigerator 10 shown in FIG. 14; and FIG. 16 is a partial enlarged view of part B in FIG. 15.

In some alternative embodiments, the installation device 100 further includes: the insertion strip 400 connected between the two refrigerators 10, and the connecting sheet 800 for connecting and fixing each of the refrigerators 10 and the insertion strip 400.

When the two built-in refrigerators 10 are required to be installed in an installation space, the insertion strip 400 can be used for shading a gap between the two refrigerators 10 to increase the aesthetics; the connecting sheet 800 can prevent the two refrigerators 10 from producing relative displacement to increase installation stability.

The insertion strip 400 has an insertion surface 410 kept flush with a front plate of the refrigerator 10 and having the same height as the front plate of the refrigerator 10, and an insertion wall 420 extending backward from the insertion surface 410 in a direction perpendicular to the insertion surface 410. The insertion surface 410 shades the gap between the two refrigerators 10 to make a modular refrigerator 10 keep aesthetic. The number of the insertion wall 420 is two, and the insertion walls 420 are parallelly disposed in an interval to make each of the insertion walls 420 disposed with a side plate of one refrigerator 10 in an abutting manner respectively. In some alternative embodiments, the installation device 100 further includes: at least one magnetic plaster, wherein the magnetic plaster may be located between the insertion wall 420 and the side plate of the refrigerator 10 to increase the adhesive force between the side plate of the refrigerator 10 and the insertion wall 420, so that the position stability of the modular refrigerator 10 can be improved when the modular refrigerator 10 is used, thereby reducing or avoiding the absolute displacement or relative displacement happening when the refrigerator 10 is used.

In some alternative embodiments, the above installation device 100 and an auxiliary installation assembly 500 can also achieve a quick installation of one refrigerator 10 or the plurality of modular refrigerators 10.

According to a built-in refrigerator 10, an installation device 100 and an auxiliary installation assembly 500 therefor of the present embodiment, the installation device 100 for the built-in refrigerator 10 includes a guide block, wherein the bottom of the guide block is provided with a groove 212 parallel to the front-back extension direction of the refrigerator 10, and the groove 212 is configured to match with a guide rail portion 512 pre-installed on the ground where the installation space is located to limit the refrigerator 10 to move in the front-back direction, so that the refrigerator 10 can move backward along a preset path to the installation position, the operation is simple, time-saving and labor-saving, avoiding the problem that in a moving process, due to uneven stress, the box body of the refrigerator 10 is skewed, moves forward in a winding manner, and can hardly get in and out of the installation space, and reducing the installation difficulty of the built-in refrigerator 10.

Thus, it should be appreciated by those skilled in the art that while various exemplary embodiments of the invention have been shown and described in detail herein, many other variations or modifications which are consistent with the principles of the present invention may be determined or derived directly from the disclosure of the present invention without departing from the spirit and scope of the present invention. Accordingly, the scope of the present invention should be understood and interpreted to cover all such other variations or modifications.

The invention claimed is:

1. An installation device for a built-in refrigerator, used for installing the refrigerator into an installation space in a cabinet, the installation device comprising:

a fixing frame, disposed on a bottom plate of the refrigerator in a front-back extension direction of the refrigerator; and a plurality of guide blocks, disposed at intervals along the fixing frame, wherein a bottom of each of the plurality of guide blocks is provided with a groove parallel to the front-back extension direction of the refrigerator, and the groove of at least one of the plurality of guide blocks is configured to match a guide rail portion pre-installed on the ground where the installation space is located, to limit the refrigerator to move in the front-back extension direction, wherein the plurality of guide blocks comprises a first guide block located at a back end of the fixing frame, and wherein a back portion of the first guide block is formed with a bell mouth expanding backward from a lateral side wall of the groove, the bell mouth being configured to be assembled with one side of the guide rail portion that faces an outside of the installation space, to guide the refrigerator into the guide rail portion.

2. The installation device according to claim 1, further comprising:

a plurality of leveling feet disposed at a bottom of the refrigerator, located in front of a front bottom pulley of the refrigerator, and configured to level the refrigerator by adjusting a height thereof.

3. A built-in refrigerator, comprising:

a box body; and the installation device according to claim 1, the installation device being disposed at a bottom of the box body.

4. The installation device according to claim 1, further comprising:

a plurality of pulley assemblies disposed in the intervals between the plurality of guide blocks and configured to slide along a surface of the guide rail portion to decrease frictional resistance generated when the refrigerator moves.

5. The installation device according to claim 4, wherein a pulley assembly of the plurality of pulley assemblies comprises:

a plurality of runners sequentially arranged in an extension direction of the groove, wherein an outer peripheral edge of the runners is formed in a shape matching a top end of the guide rail portion; and a connector having a shaft hole for matching two ends of a central rotating shaft of each runner, so that the central rotating shaft of the plurality of runners is rotatably connected onto the connector.

6. The installation device according to claim 5, wherein the connector comprises two connectors respectively on two lateral sides of the plurality of runners, and the pulley assembly further comprises:

a fixing shaft disposed between the two connectors in a penetrating manner; and a cover housing fixedly connected to two ends of the fixing shaft and configured to limit the plurality of runners in the cover housing, wherein a bottom of the cover housing is provided with an opening to allow the plurality of runners to be in contact with the surface of the guide rail portion.

7. An auxiliary installation assembly for a built-in refrigerator, used for installing the refrigerator into an installation space in a cabinet, the auxiliary installation assembly comprising:

a rail assembly configured to at least be disposed on a lateral side of a ground where the installation space is located, and configured to be disposed in a front-back extension direction of the ground, to allow the refrigerator to get in and out of the installation space in the front-back extension direction, and the rail assembly comprises:

a bottom plate portion, configured to be laid on the ground; and a guide rail portion formed extending upward from a surface of the bottom plate portion and configured to allow a guide block of the installation device according to claim 1 to move along the surface thereof; and a limiting portion formed extending upward from the surface of the bottom plate portion and disposed parallel to the guide rail portion at an interval.

8. The auxiliary installation assembly according to claim 7, wherein the auxiliary installation assembly further comprises:

a positioning member configured to be disposed on the ground parallel to an extension direction of the rail assembly, and having a positioning strip parallel to the limiting portion, wherein the guide rail portion is located between the positioning strip and the limiting portion, and the positioning member is further configured to match the limiting portion to adjust a moving path of the refrigerator when the guide block deviates from the guide rail portion; and a pad located between the rail assembly and the positioning member and configured to elevate a back bottom pulley of the refrigerator when the refrigerator moves to an installation position.

* * * * *